US012446651B2

(12) United States Patent
Thayer

(10) Patent No.: US 12,446,651 B2
(45) Date of Patent: Oct. 21, 2025

(54) TWO-PIECE INJECTION MOLDED SHOE SYSTEM

(71) Applicant: Triple T Trading Ltd, Marysville, WA (US)

(72) Inventor: Bob Thayer, Marysville, WA (US)

(73) Assignee: TRIPLE T TRADING LTD, Marysville, WA (US)

( * ) Notice: Subject to any disclaimer, the term of this patent is extended or adjusted under 35 U.S.C. 154(b) by 0 days.

(21) Appl. No.: 18/480,182

(22) Filed: Oct. 3, 2023

(65) Prior Publication Data

US 2025/0107589 A1 Apr. 3, 2025

(51) Int. Cl.

| | |
|---|---|
| ***A43B 3/24*** | (2006.01) |
| ***A43B 3/12*** | (2006.01) |
| ***A43B 13/22*** | (2006.01) |
| ***A43B 13/38*** | (2006.01) |

(52) U.S. Cl.

CPC ..... *A43B 3/128* (2013.01); *A43B 3/24* (2013.01); *A43B 3/244* (2013.01); *A43B 13/22* (2013.01); *A43B 13/38* (2013.01)

(58) Field of Classification Search

CPC ..... A43B 3/24; A43B 3/244; A43B 3/248; A43B 13/36; A43B 13/28; A43C 13/12

USPC ..... 36/15, 100, 101, 7.1 R

See application file for complete search history.

(56) References Cited

U.S. PATENT DOCUMENTS 2,183,277 A * 12/1939 Heilhecker ..... A43B 13/36 36/15
3,538,628 A * 11/1970 Einstein, Jr. ..... A43B 3/0078 36/15
3,952,358 A * 4/1976 Fukuoka ..... A43B 1/0054 12/142 MC
4,267,650 A * 5/1981 Bauer ..... A43B 3/24 36/15
4,317,294 A * 3/1982 Goodyear ..... A43B 13/36 36/36 B
4,351,120 A * 9/1982 Dalebout ..... A43B 13/36 36/117.3
4,887,369 A * 12/1989 Bailey ..... A43B 3/24 36/15
5,317,822 A * 6/1994 Johnson ..... A43B 13/36 36/15

(Continued)

FOREIGN PATENT DOCUMENTS

| | | | |
|---|---|---|---|
| AU | 2007202120 | A1 | 11/2007 |
| CA | 2521918 | A1 | 3/2007 |

*Primary Examiner* — Marie D Bays

(74) *Attorney, Agent, or Firm* — Miller Nash LLP

(57) ABSTRACT

A shoe system is disclosed. The system includes a first shoe portion including one or more plugs extending from the first shoe portion. The system further includes a second shoe portion including one or more apertures formed in the second shoe portion and sized to receive the one or more plugs of the first shoe portion. The second shoe portion is configured to be removably connected to the first shoe portion when the one or more plugs of the first shoe portion are received in the one or more apertures of the second shoe portion. The first and second shoe portions may each consist of a single injection piece from EVA foam. The second shoe portion may further include a tread portion configured to make the second shoe portion have desirable characteristics for a given situation or usage, for example, to make the second shoe portion oil- and/or slip-resistant.

21 Claims, 10 Drawing Sheets

(56) References Cited

U.S. PATENT DOCUMENTS 5,661,915 A * 9/1997 Smith ..... A43C 15/00 36/102
5,836,090 A 11/1998 Smith
6,023,859 A * 2/2000 Burke ..... A43B 13/36 36/105
6,813,847 B2 11/2004 Workman
7,331,123 B2 2/2008 Workman et al.
7,451,557 B2 * 11/2008 McDonald ..... A43B 3/246 36/105
7,814,682 B2 * 10/2010 Grove ..... A43B 13/36 36/15
7,966,748 B2 * 6/2011 Votolato ..... A43C 15/02 36/15
8,020,318 B2 * 9/2011 Khalifa ..... A43B 1/0027 36/103
8,544,189 B2 10/2013 Chaney et al.
8,991,071 B2 * 3/2015 Bathum ..... A43B 1/0027 36/11.5
10,681,955 B2 6/2020 Beers et al.
D924,549 S 7/2021 Chaney et al.
2002/0174569 A1 * 11/2002 Tsai ..... A43B 3/103 36/11.5
2005/0060914 A1 * 3/2005 Fuerst ..... B29D 35/122 36/102
2005/0268491 A1 * 12/2005 McDonald ..... A43B 9/00 36/28
2007/0251124 A1 * 11/2007 Holbert ..... A43B 13/187 36/61
2007/0289161 A1 * 12/2007 Gerber ..... A43B 3/0047 36/12
2009/0183392 A1 * 7/2009 Shane ..... A43B 3/244 12/114.2
2010/0101113 A1 * 4/2010 Paik ..... A43B 21/39 36/100
2016/0029739 A1 * 2/2016 Dias ..... A43B 13/22 36/15
2016/0324264 A1 * 11/2016 Johnson ..... A43B 3/244
2019/0142110 A1 * 5/2019 Cruz ..... A43B 3/16 36/15
2019/0216172 A1 * 7/2019 De Callatay ..... A43D 67/00
2021/0045497 A1 2/2021 Cruz et al.
2021/0330037 A1 10/2021 Chaney et al.
2022/0227086 A1 * 7/2022 Yeh ..... B29C 45/1675
2024/0122295 A1 * 4/2024 Matsuhisa ..... A43B 3/102

* cited by examiner

100

100

200

TWO-PIECE INJECTION MOLDED SHOE SYSTEM

FIELD OF THE INVENTION

This disclosure is directed to a two-piece injection molded shoe system and applications thereof, including a multi-function shoe system.

BACKGROUND

Shoes have traditionally been limited to particular applications. For instance, a runner may utilize a running shoe; a hiker, a hiking boot; an office worker, a loafer or heel; and a person on vacation, a flip-flop. Since shoes have traditionally been limited to a particular application, a person looking to perform different activities has needed to have multiple different shoes specific to each of those activities. This has had a very limiting effect on consumers, and can be quite costly to them as well.

Shoes have also traditionally been constructed of different materials based on these different applications. For some applications, shoes must be constructed of materials that result in the shoe having specific qualities necessary or desirable for the given application. For example, first response workers may find themselves in a variety of treacherous conditions, such that having a shoe with an oil-resistant or slip-resistant sole is necessary or desirable. The first response worker thus may own, for example, close-toed shoes with an oil- and slip-resistant sole. But the first response worker has traditionally been limited to that close-toed shoe, unable to readily switch to something more comfortable like a flip-flop or slide, because such casual shoes do not have an oil- and slip-resistant sole. So even in her downtime, the first response worker must wear the close-toed shoe with the oil-and-slip resistant sole, which can be quite limiting and undesirable for her.

Even for consumers without the need for a shoe for a specific application, traditional shoes can be quite limiting. To own, for example, a clog, a sneaker, a flip-flop, and a slide has traditionally required the consumer to own four separate pairs of shoes. This requires four separate purchases of four complete pairs of shoes, often from four different companies, which can be burdensome, expensive, and time-intensive for the consumer.

Embodiments of the invention address these and other shortcomings of the prior art.

DETAILED DESCRIPTION OF THE EMBODIMENTS

Figure 1A:
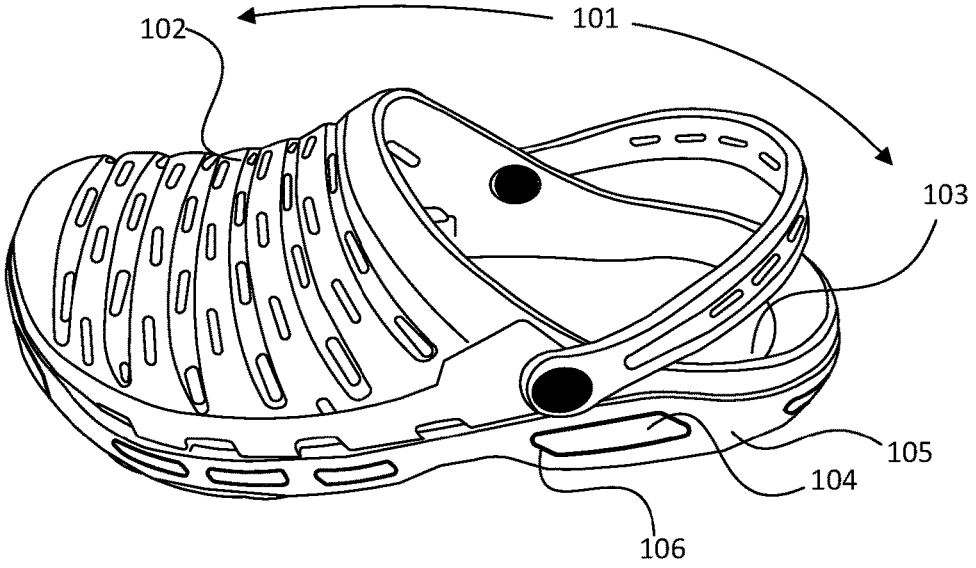
FIG. 1A is a top view of a two-piece injection molded shoe system according to embodiments of the invention.
Figure 1B:
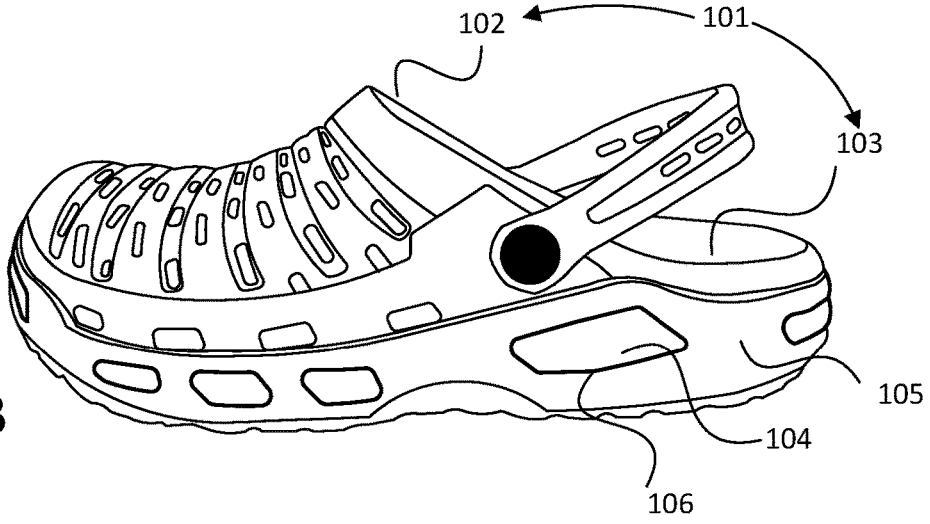
FIG. 1B is a lateral side view of a two-piece injection molded shoe system according to embodiments of the invention.
Figure 1C:
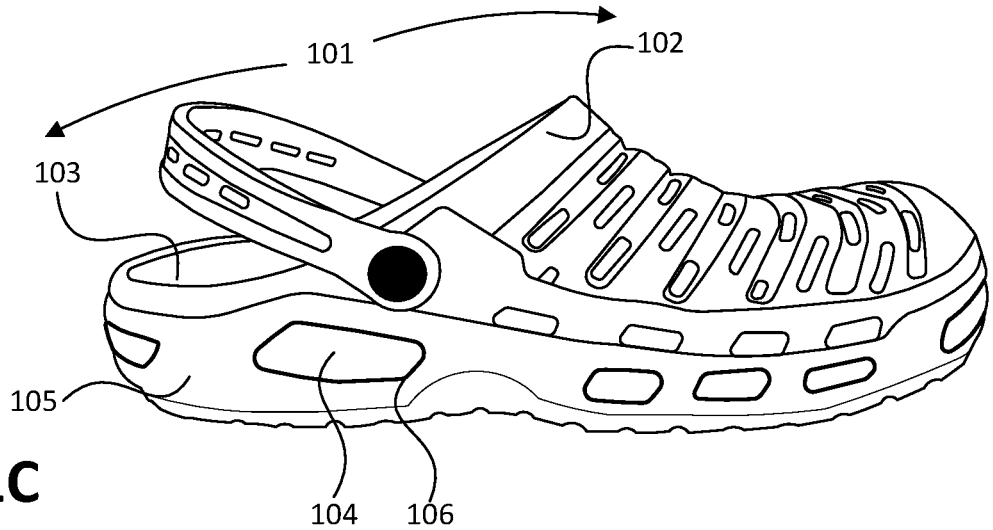
FIG. 1C is a medial side view of a two-piece injection molded shoe system according to embodiments of the invention.
Figure 1D:
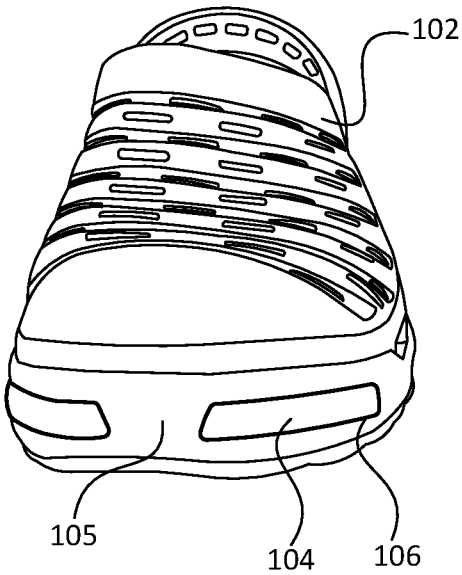
FIG. 1D is a front view of a two-piece injection molded shoe system according to embodiments of the invention.
Figure 1E:
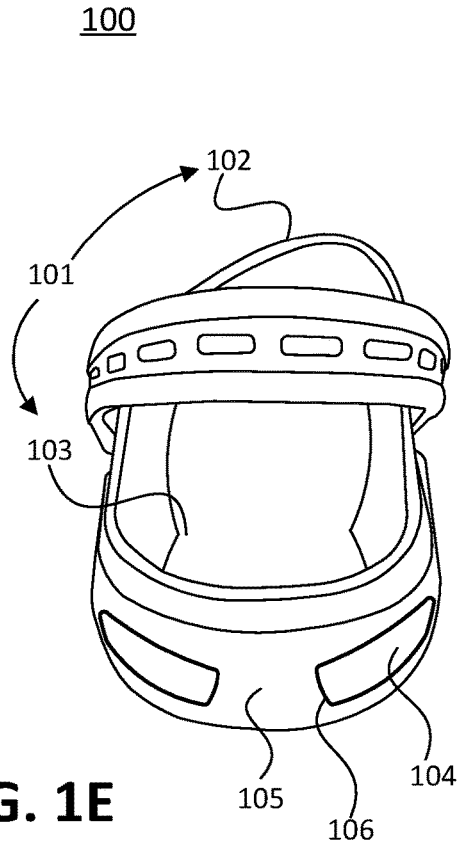
FIG. 1E is a back view of a two-piece injection molded shoe system according to embodiments of the invention.

The embodiments described herein provide a two-piece shoe system and, more particularly, a two-piece injection molded shoe system having interchangeable uppers or outsoles, providing the ability for a user to have multiple styles of uppers to wear in one shoe system.

FIGS. 1A-1E show one shoe of a two-piece injection molded shoe system 100 according to an embodiment of the invention, wherein a first shoe portion 101 and a second shoe portion 105 are securely, semi-permanently, removably connected to each other via plugs 104 extending from the first shoe portion 101 being received in corresponding apertures 106 formed in the second shoe portion 105. While only one shoe is shown in FIGS. 1A-1E, it should be understood that the system 100 would typically be comprised of two shoes, one for a left foot and one for a right foot, which would be mirror images of each other, as is standard for pairs of shoes.

FIGS. 2A-2E show a two-piece injection molded shoe system 200 according to an embodiment of the invention, wherein the first shoe portion 101 and the second shoe portion 105 are disconnected via removal of plugs 104 from the apertures 106. Such a connection permits interchangeability between the first and second shoe portions using one's hands, but not merely using one's feet or merely while walking in the two-piece shoe system 100. In this manner, the first shoe portion 101 and second shoe portion 105 do not detach while the user is wearing or using the shoe system 100. While only one shoe is shown in FIGS. 2A-2E, it should be understood that the system would typically be comprised of two shoes, one for a left foot and one for a right foot, which would be mirror images of each other, as is standard for pairs of shoes.

Shoe system 200 includes a first shoe portion 101 with an upper portion 102 and an insole portion 103. The upper portion 102 is configured to be worn substantially over and around the sides and top of a foot of a wearer, while the insole portion 103 is configured to be worn substantially under the foot of a wearer. The upper portion 102 and the insole portion 103 may be formed as a single injection piece. In an embodiment, the upper portion 102 and insole portion 103 are formed as a single injection piece from ethylene-vinyl acetate (EVA) foam, a soft and durable polymer that is light weight and cushioning in nature. Other materials can alternatively be used. In another embodiment, the upper portion 102 and the insole portion 103 may be formed as separate pieces that are combined through any conventional means.

As shown in FIGS. 1A-1E, the upper portion 102 can be in the style of a clog with a heel strap. However, the upper portion 102 can be any shoe style. For instance, the upper portion 102 could be in the style of a clog without a heel strap, a mule, a slip-on, a sneaker, a close-toed shoe, a slide, a flip-flop, a boot, or any other style of shoe.

The shoe system 100 also includes a second shoe portion 105. The second shoe portion 105 is configured to fit substantially under the insole portion 103 of the first shoe portion 101, with sides that permit the insole portion 103 of the first shoe portion 101 to be received within the second shoe portion 105. The second shoe portion 105 may be formed as a single injection piece. In an embodiment, the second shoe portion is formed as a single injection piece from EVA foam. Other materials can alternatively be used. In another embodiment, the second shoe portion 105 may be formed as multiple pieces that are combined through any conventional means, for example, as an outsole with an additional sole attached thereto.

Figure 1F:
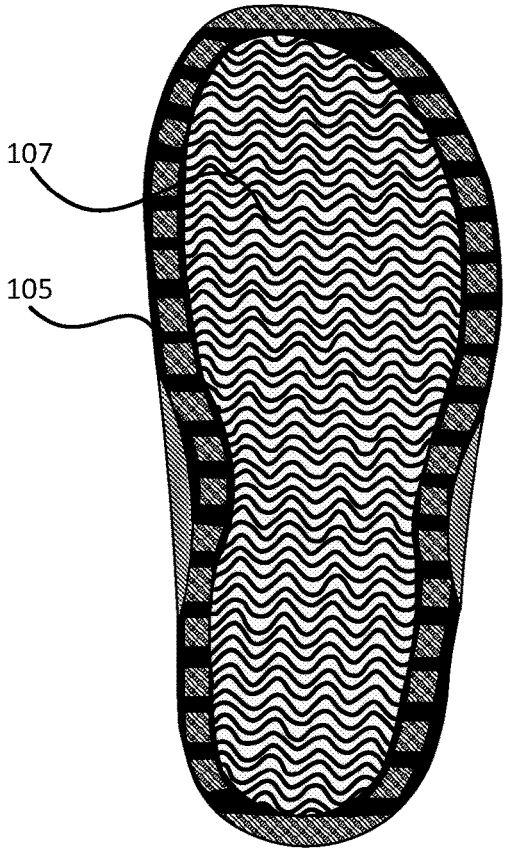
FIG. 1F is a bottom view of a two-piece injection molded shoe system according to embodiments of the invention.

In an embodiment, the second shoe portion 105 includes a tread portion 107 on a bottom side of the second shoe portion 105 (see FIG. 1F). The tread portion 107 may be a separate piece combined with the second shoe portion 105 through any conventional means, for example, by gluing the tread portion 107 to the bottom side of the second shoe portion 105. Alternatively, second shoe portion 105 and tread portion 107 may be formed as a single injection piece from EVA foam. Tread portion 107 may be sized smaller than the bottom side of the second shoe portion 105, such that a portion of the bottom side of the second shoe portion 105 remains exposed. Alternatively, tread portion 107 may be sized to be substantially the same size and shape as the bottom side of the second shoe portion 105.

In an embodiment, the tread portion 107 includes a tread pattern configured to make the second shoe portion 105 have desirable characteristics for a given situation or usage. For example, the tread pattern can be configured to make the second shoe portion 105 oil-resistant and/or slip-resistant. In another embodiment, the tread pattern can be configured to make the second shoe portion 105 ideal for hiking or similar applications. In another embodiment, the bottom side of the second shoe portion 105 may be made of a material that makes the bottom side oil- and/or slip-resistant, instead of or in addition to the tread pattern itself being configured to make the second shoe portion oil-resistant and/or slip-resistant.

In an embodiment, and as can be seen in FIGS. 2B-2F, the first shoe portion 101 includes one or more plugs 104 configured to be received in one or more apertures 106 in the second shoe portion 105, as shown in FIGS. 1A-1D. In an embodiment, the one or more apertures 106 of the second shoe portion 105 are sized to receive the one or more plugs 104 of the first shoe portion. In an embodiment, the one or more plugs 104 are sized such that they extend substantially all the way through the one or more apertures 106 in the second shoe portion 105. In this manner, the first shoe portion 101 and second shoe portion 105 can be securely, semi-permanently, removably connected to each other by receiving the one or more plugs 104 of the first shoe portion 101 in the corresponding one or more apertures 106 of the second shoe portion 105. By extending substantially all the way through the corresponding apertures 106, the plugs 104 provide for a secure, semi-permanent, removable attachment, as well as the ability for the shoe system 101 to have a contrasting design where the first shoe portion 101 and the second shoe portion 105 are different colors, patterns, or textures.

Figure 2A:
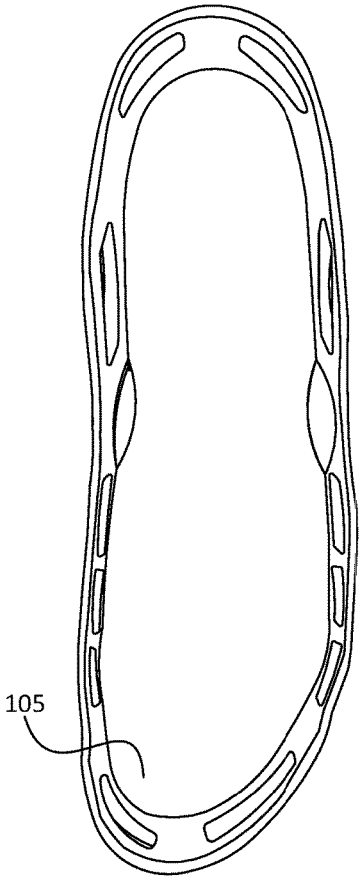
FIG. 2A is a top view of the second shoe portion of a two-piece injection molded shoe system according to embodiments of the invention.
Figure 2B:
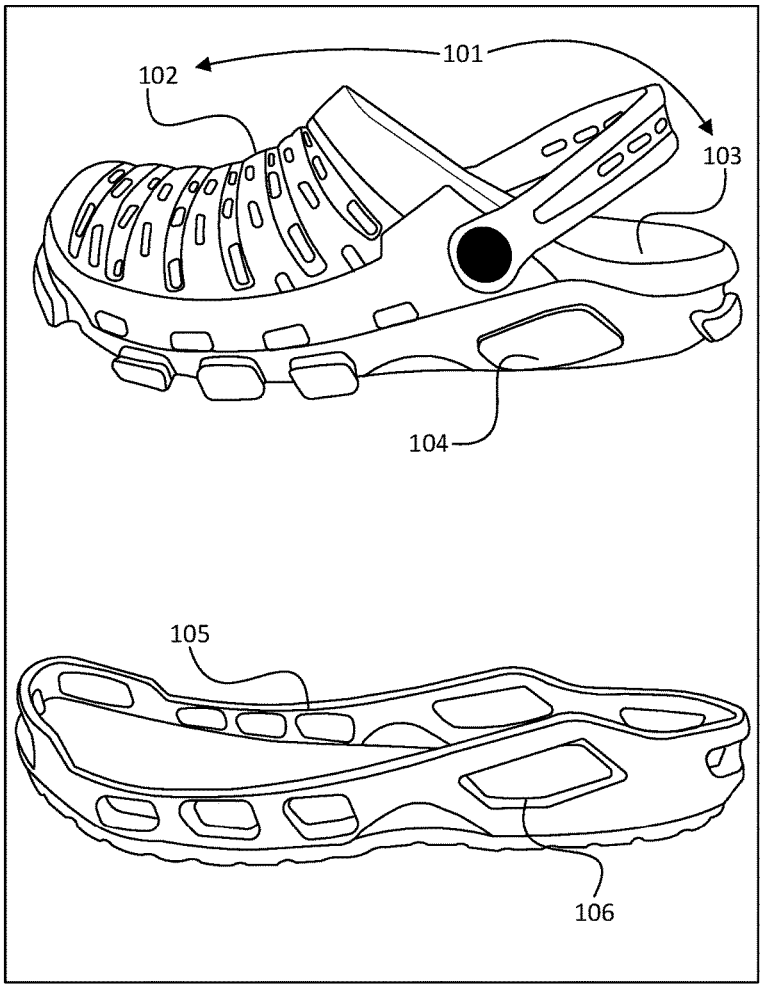
FIG. 2B is a lateral side view of the first and second shoe portions of a two-piece injection molded shoe system according to embodiments of the invention.
Figure 2C:
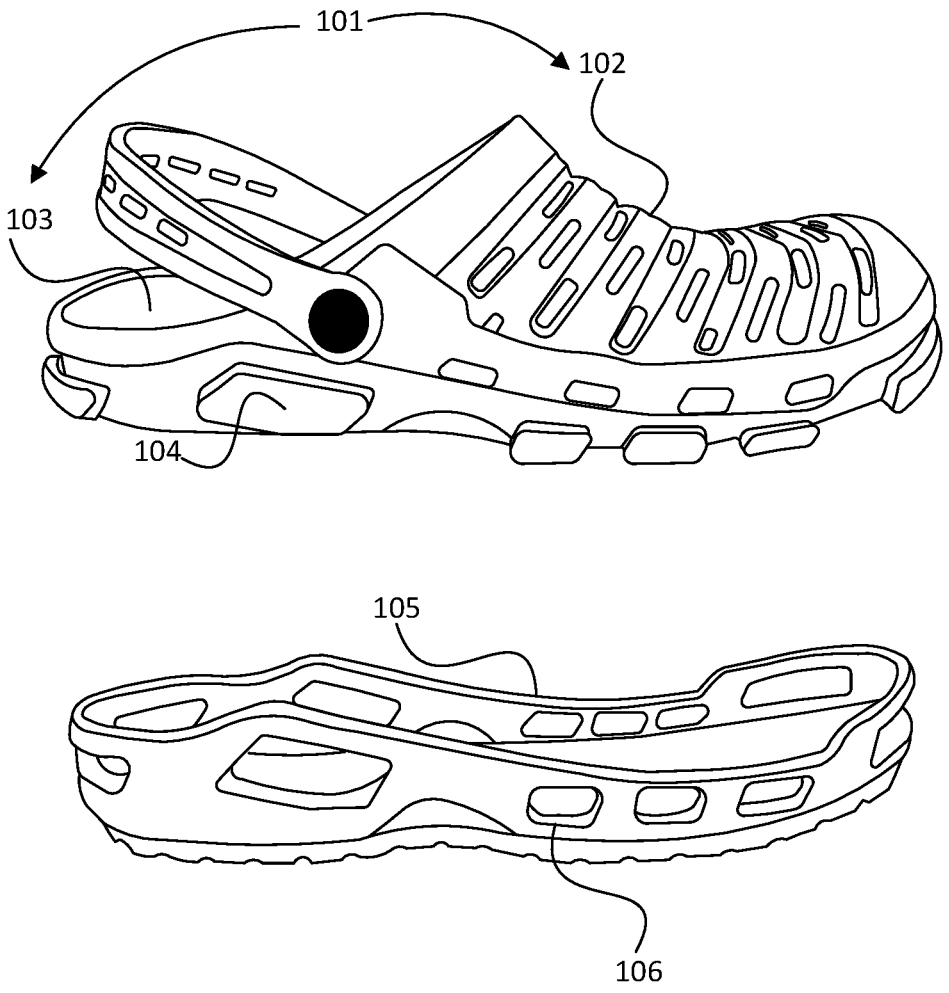
FIG. 2C is a medial side view of the first and second shoe portions of a two-piece injection molded shoe system according to embodiments of the invention.
Figure 2D:
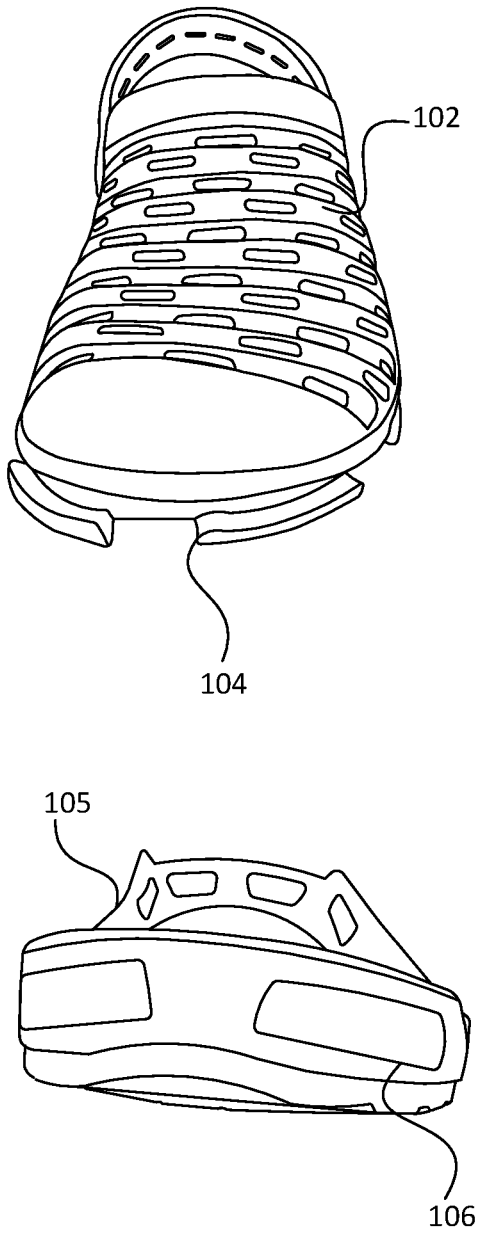
FIG. 2D is a front view of the first and second shoe portions of a two-piece injection molded shoe system according to embodiments of the invention.
Figure 2E:
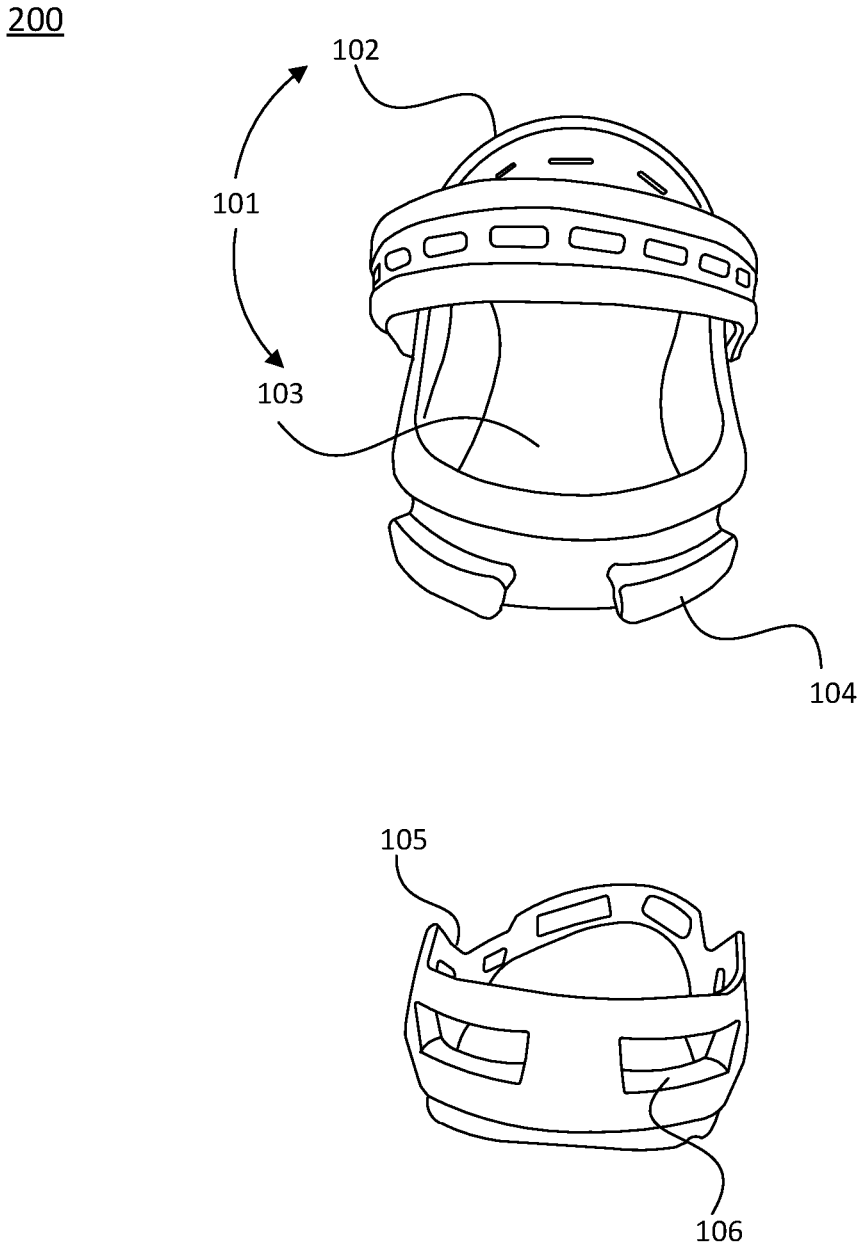
FIG. 2E is a back view of the first and second shoe portions of a two-piece injection molded shoe system according to embodiments of the invention.
Figure 2F:
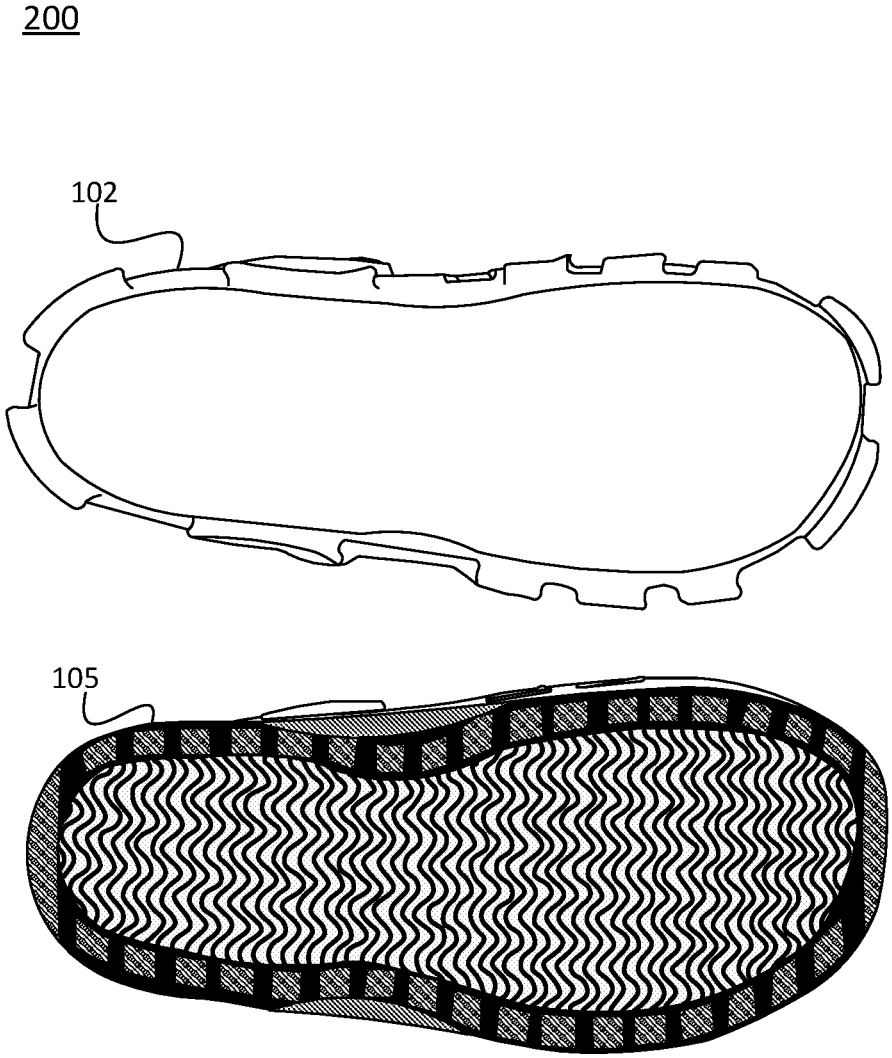
FIG. 2F is a bottom view of a two-piece injection molded shoe system according to embodiments of the invention.

As shown in the embodiment in FIGS. 2B-2F, first shoe portion 101 may include one or more plugs 104 extending substantially laterally from the lateral side of the first shoe portion 101 (FIG. 2B), one or more plugs 104 extending substantially laterally from the medial side of the first shoe portion 101 (FIG. 2C), one or more plugs 104 extending substantially laterally from the front side (toe area) of the first shoe portion 101 (FIG. 2D), and one or more plugs extending substantially laterally from the back side (heel area) of the first shoe portion 101 (FIG. 2E). In this manner, multiple plugs 104 extend substantially laterally from all sides of the first shoe portion 101.

In the embodiment shown in FIGS. 2B-2F, four plugs 104 extend substantially laterally from the lateral side of the first shoe portion 101 (FIG. 2B), four plugs 104 extend substantially laterally from the medial side of the first shoe portion 101 (FIG. 2C), two plugs 104 extend substantially laterally from the front side (toe area) of the first shoe portion 101 (FIG. 2D), and two plugs 104 extend substantially laterally from the back side (heel area) of the first shoe portion 101 (FIG. 2E). Correspondingly, four apertures 106 are formed in the lateral side of the second shoe portion 105 (FIG. 2B), four apertures 106 are formed in the medial side of the second shoe portion 105 (FIG. 2C), two apertures 106 are formed in the front side (toe area) of the second shoe portion 105 (FIG. 2D), and two apertures 106 are formed in the back side (heel area) of the second shoe portion 105 (FIG. 2E). In this manner, plugs 104 extend substantially laterally from all sides of the first shoe portion 101 and have corresponding apertures 106 in the second shoe portion 105, enabling a secure, semi-permanent, removable connection between the first shoe portion 101 and the second shoe portion 105 when they are connected via the plugs 104 being received in their corresponding apertures 106. Other numbers, configurations, and placements of plugs 104 and corresponding apertures 106 can be used to enable a secure, semi-permanent, removable connection between the two shoe portions. Such a connection permits interchangeability between the first and second shoe portions using one's hands, but not merely using one's feet or merely while walking in the two-piece shoe system 101. In this manner, the first shoe portion 101 and second shoe portion 105 do not detach while the user is wearing or using the shoe system 100.

In an embodiment, the one or more plugs 104 extending laterally from the sides of the first shoe portion 101 are substantially parallelogram in shape, with the one or more apertures 106 in the second shoe portion 105 also being substantially parallelogram in shape and sized to receive the plugs 104. However, any combination and types of shapes can be used for the plugs and corresponding apertures, such as but not limited to triangles, rectangles, parallelograms, circles, squares, rhombuses, ovals, pentagons, hexagons, heptagons, octagons, and so on. These and other shapes can also be used to create different contrasting designs when the first shoe portion 101 and second shoe portion 105 are different colors, patterns, or textures. For example, the plugs 104 and corresponding apertures 106 can be substantially star-shaped, creating a contrasting star design; heart-shaped, creating a contrasting heart design; or any other conceivable shape that still allows for the plugs 104 and apertures 106 to function to securely, semi-permanently, removably connect the two shoe portions.

Figure 3:
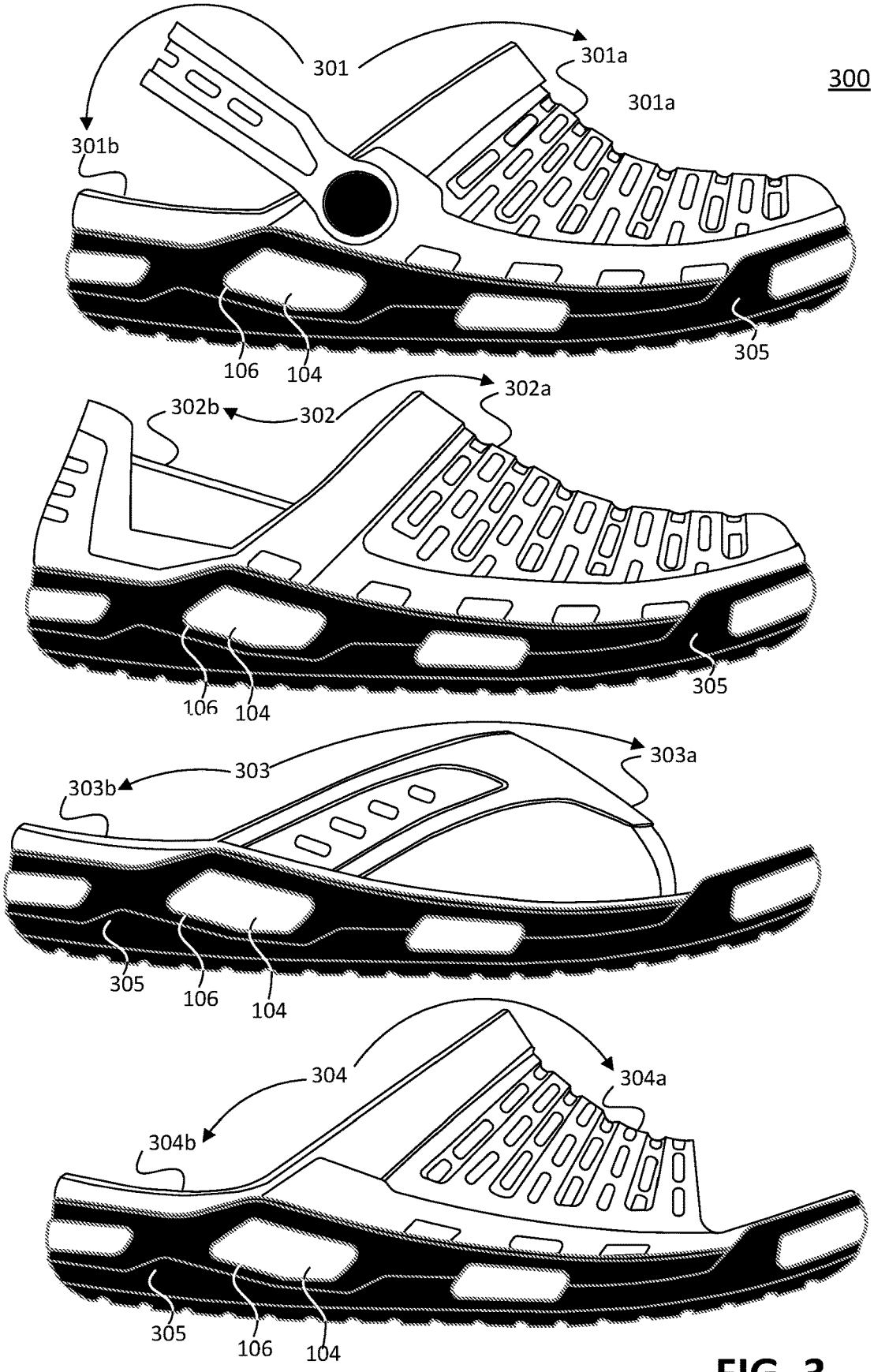
FIG. 3 is a lateral side view of a multi-function shoe system according to embodiments of the invention.

Turning to FIG. 3, an embodiment multi-function shoe system 300 is shown. While in FIG. 3 a second shoe portion 305 is shown in connection with each first shoe portion 301, 302, 303, 304 to illustrate the secure, semi-permanent, removable connection between each shoe portion, in an embodiment the multi-function shoe system 300 only includes one second shoe portion 305, configured to be securely, semi-permanently, removably connected to multiple first shoe portions 301, 302, 303, 304. In this manner, multiple first shoe portions 301, 302, 303, 304 are interchangeable with a single second shoe portion. Thus, with a single multi-function shoe system 300, a user has the ability to obtain and wear multiple styles of shoes via interchangeable first shoe portions 301, 302, 303, 304 and only one second shoe portion 305.

In the embodiment multi-function shoe system 300 shown in FIG. 3, the system 300 includes one first shoe portion 301 in the style of a clog with heel strap, one first shoe portion 302 in the style of a loafer, one first shoe portion 303 in the style of a flip-flop, and one first shoe portion 304 in the style of a slide. However, first shoes portions 301, 302, 303, 304 can be any other combination of shoe styles (clog without a heel strap, a slip-on, a mule, a sneaker, a close-toed shoe, a slide, a flip-flop, a boot, or any other style of shoe); can all be the same shoe style but in different colors, textures, or patterns; can all be different shoes styles in the same color, texture, or pattern; or any other combination of styles, colors, textures, or patterns. In an embodiment, the multi-function shoe system 300 may include fewer first shoe portions, for example, may only include two or three first shoe portions. In another embodiment, the multi-function shoe system 300 may include more first shoe portions, for example, may include five or more first shoe portions. In another embodiment, the multi-function shoe system 300 may include more than one second shoe portions.

Each of the first shoe portions 301, 302, 303, and 304 include one or more plugs 104 extending from the first shoe portions. In an embodiment, one or more plugs 104 extend substantially laterally from one or more sides of each first shoe portion 301, 302, 303, 304.

Each of the first shoe portions 301, 302, 303, 304 include an upper portion 301*a*, 302*a*, 303*a*, 304*a*, and an insole portion 301*b*, 302*b*, 303*b*, 304*b*. Each upper portion 301*a*, 302*a*, 303*a*, 304*a* is configured to be worn substantially over and around the sides and the top of a foot of a wearer, and each insole portion 301*b*, 302*b*, 303*b*, 304*b* is configured to be worn substantially under the foot of a wearer. In an embodiment, each upper portion 301*a*, 302*a*, 303*a*, 304*a* is formed as a single injection piece with its respective insole portion 301*b*, 302*b*, 303*b*, 304*b*, such that each first shoe portion 301, 302, 303, 304 is formed as a single injection piece. In an embodiment, the single injection piece is formed from EVA foam. Other materials can alternatively be used. In another embodiment, each upper portion 301*a*, 302*a*, 303*a*, 304*a* may be formed as a separate piece from its respective insole portion 301*b*, 302*b*, 303*b*, 304*b*, which are combined through any conventional means.

In an embodiment, multi-function shoe system 300 also includes a second shoe portion 305 configured to be securely, semi-permanently, removably connected to each of the first shoe portions 301, 302, 303, 304. The second shoe portion 305 includes one or more apertures 106 through which the one or more plugs 104 of any of the first shoe portions 301, 302, 303, 304 can be received, the plugs 104 extending substantially all the way through the corresponding apertures 106. By extending substantially all the way through the corresponding apertures 106, the plugs 104 provide for a secure, semi-permanent, removable attachment, as well as the ability for a contrasting design where the first shoe portion 301, 302, 303, 304 connected to the one second shoe portion 305 is a different color, pattern, or texture from the second shoe portion 305.

In an embodiment, each first shoe portion 301, 302, 303, 304 uses approximately the same number, size, shape, and configuration of plugs 104, and the second shoe portion 305 uses a corresponding number, size, shape, and configuration of apertures 106. In this manner, the second shoe portion 305 is interchangeable with each of the first shoe portions 301, 302, 303, 304.

In the embodiment shoe system 300 shown in FIG. 3, the plugs 104 extending substantially laterally from the sides of each first shoe portion 301, 302, 303, 304 are substantially parallelogram in shape, and the corresponding apertures 106 in the second shoe portion 305 are also substantially parallelogram in shape and sized to receive the plugs 104. However, any combination and types of shapes can be used for the plugs and corresponding apertures in shoe system 300, so long as each first shoe portion 301, 302, 303, 304 uses approximately the same number, size, shape, and configuration of plugs 104. For instance, the plugs and corresponding apertures may be triangles, rectangles, parallelograms, circles, squares, rhombuses, ovals, pentagons, hexagons, heptagons, octagons, and so on. These and other shapes can also be used to create different contrasting designs when each first shoe portion 301, 302, 303, 304 is a different color, pattern, or texture than the one second shoe portion 305. For example, the plugs 104 and corresponding apertures 106 can be substantially star-shaped, creating a contrasting star design; heart-shaped, creating a contrasting heart design; or any other conceivable shape that still allows for the plugs 104 and apertures 106 to function to securely, semi-permanently, removably connect the one second shoe portion 305 to each of the first shoe portions 301, 302, 303, 304 at a given time.

In an embodiment shoe system 300, the one second shoe portion 305 includes a tread portion 107 on a bottom side of the one second shoe portion 305, such as the tread portion 107 in FIG. 1F. The tread portion 107 may be a separate piece combined with the one second shoe portion 305 through any conventional means, for example, by gluing the tread portion 107 to the bottom side of the one second shoe portion 305. Alternatively, the one second shoe portion 305 and tread portion 107 may be formed as a single injection piece from EVA foam. As in FIG. 1F, tread portion 107 may be sized smaller than the bottom side of the one second shoe portion 305. Alternatively, tread portion 107 may be sized to be substantially the same size and shape as the bottom side of the one second shoe portion 305.

In an embodiment shoe system, the tread portion 107 includes a tread pattern configured to make the one second shoe portion 305 have desirable characteristics for a given situation or usage. For example, the tread pattern can be configured to make the one second shoe portion 305 oil-resistant and/or slip-resistant. In another embodiment, the tread pattern can be configured to make the one second shoe portion 305 ideal for hiking or similar applications. In another embodiment, the bottom side of the second shoe portion 305 may be made of a material that makes the bottom side oil- and/or slip-resistant, instead of or in addition to the tread pattern itself being configured to make the second shoe portion oil-resistant and/or slip-resistant. In this manner, a consumer having a need for a particular type of shoe sole but a desire for multiple shoe styles can meet both the need and desire with a single shoe system 300. For example, a first responder may need a shoe with an oil-resistant or slip-resistant sole. With the shoe system 300, the first responder can have multiple styles of shoe, all with the same oil- and/or slip-resistant sole, providing versatility, flexibility, and customizability to the user.

In an embodiment shoe system 300, instead of multiple first shoe portions and one second shoe portion, there is one first shoe portion and two or more second shoe portions. The first shoe portion includes an upper portion and insole portion and is formed as a single injection piece of EVA foam. Other materials can alternatively be used. Each of the second shoe portions are formed as separate single injection pieces of EVA foam. Other materials can alternatively be used. The one first shoe portion includes one or more plugs 104 configured to be received in corresponding one or more apertures 106 formed in each of the two or more second shoe portions, as described herein with reference to other embodiments. Each of the two or more second shoe portions use approximately the same number, size, shape, and configuration of apertures 106, corresponding to the number, size, shape, and configuration of plugs 104 extending from the one first shoe portion. In this manner, the one first shoe portion is interchangeable with each of the two or more second shoe portions. In such a shoe system, each of the second shoe portions can be configured for a different purpose. For example, the shoe system 300 could include one second shoe portion that is oil- and/or slip-resistant; one second shoe portion that is substantially smooth and thus more appropriate for indoor wear; and so on. In this manner, a single shoe system 300 can provide a single type of shoe (for example, a clog with a heel strap) capable of multi-purpose use.

Figure 4:
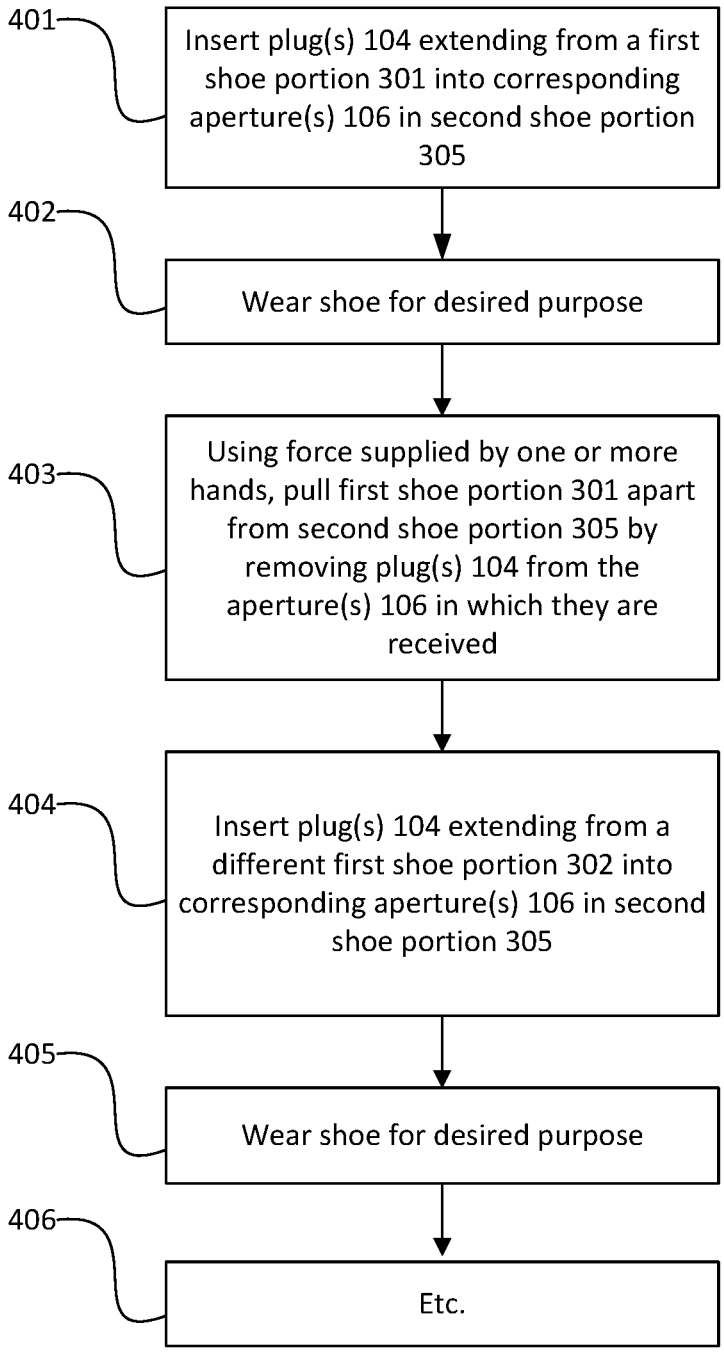
FIG. 4 is a flow chart of a method of using an embodiment multi-function shoe system according to embodiments of the invention.

Turning to FIG. 4, a method of using an embodiment multi-function shoe system is shown. In block 401, first shoe portion 301 is connected to the second shoe portion 305 by a user with her hands, inserting the plug(s) 104 extending from the first shoe portion 301 into the corresponding aperture(s) 106 of the second shoe portion 305. The user can then wear the shoe for her desired purpose, as shown at block 402. For example, in an embodiment where the first shoe portion 301 is in the style of a clog with a heel strap and the user is a nurse, the user can wear the shoe while on her shift at the hospital. In block 403, the user can disconnect first shoe portion 301 from second shoe portion 305 by supplying force with one or more of her hands, pulling the first shoe portion 301 apart from the second shoe portion 305 by removing plug(s) 104 of the first shoe portion 301 from the corresponding aperture(s) 106 of the second shoe portion. The user can then select a new first shoe portion, for example, first shoe portion 302, and at block 404, connect first shoe portion 302 to the second shoe portion 305 by inserting the plug(s) 104 extending from first shoe portion 302 into the corresponding aperture(s) 106 of the second shoe portion 305. The user can then wear this new shoe for her desired purpose, as shown at block 405. For example, in an embodiment where first shoe portion 302 is in the style of a loafer and the user is the same nurse, by changing the first shoe portion 302 the nurse is now ready to go from her shift to the grocery store. These steps of connecting and disconnecting different first shoe portions from the second shoe portion can be repeated indefinitely and as desired by the user, as shown at block 406. In this manner, the embodiment multi-function shoe system 300 provides versatility, flexibility, and customizability to the user.

This written description makes reference to particular features. It is to be understood that the disclosure in this specification includes all possible combinations of those particular features. For example, where a particular feature is disclosed in the context of a particular example configuration, that feature can also be used, to the extent possible, in the context of other example configurations.

Also, when reference is made in this application to a method having two or more defined steps or operations, the defined steps or operations can be carried out in any order or simultaneously, unless the context excludes those possibilities.

Furthermore, the terms "comprises" and "includes" and their grammatical equivalents are used in this application to mean that other components, features, steps, processes, operations, etc. are optionally present. For example, an article "comprising" or "which comprises" components A, B, and C can contain only components A, B, and C, or it can contain components A, B, and C along with one or more other components. Likewise, an article "including" or "which includes" components A, B, and C can contain only components A, B, and C, or it can contain components A, B, and C along with one or more other components.

Although specific example configurations have been described for purposes of illustration, it will be understood that various modifications may be made without departing from the spirit and scope of the disclosure.

What is claimed is:

1. A shoe system comprising:

a first shoe portion including an upper portion and an insole portion, the first shoe portion including one or more plugs extending from the first shoe portion; and a second shoe portion including one or more apertures formed in the second shoe portion and sized to receive the one or more plugs of the first shoe portion;

wherein the second shoe portion is configured to be removably connected to the first shoe portion when the one or more plugs of the first shoe portion are received in the one or more apertures of the second shoe portion, the one or more plugs of the first shoe portion configured to extend substantially all the way through the one or more apertures of the second shoe portion, and wherein only the second shoe portion contacts a walking surface when the one or more plugs of the first shoe portion are received in the one or more apertures of the second shoe portion.

2. The shoe system of claim 1, wherein the upper portion and the insole portion consist of a single injection piece.

3. The shoe system of claim 1, wherein the second shoe portion consists of a single injection piece.

4. The shoe system of claim 1, wherein the one or more plugs extending from the first shoe portion consist of one or more plugs extending laterally from the first shoe portion.

5. The shoe system of claim 4, wherein the one or more apertures formed in the second shoe portion consist of one or more apertures formed in at least one side of the second shoe portion.

6. The shoe system of claim 4, wherein the one or more plugs extending laterally from the first shoe portion are substantially of a shape selected from a group consisting of a parallelogram, a rectangle, a triangle, a circle, a square, a rhomboid, an oval, a pentagon, a hexagon, a heptagon, an octagon, a star, and a heart.

7. The shoe system of claim 5, wherein the one or more apertures formed in at least one side of the second shoe portion are substantially of a shape selected from a group consisting of a parallelogram, a rectangle, a triangle, a circle, a square, a rhomboid, an oval, a pentagon, a hexagon, a heptagon, an octagon, a star, and a heart, and which corresponds to the shape of the one or more plugs extending laterally from the first shoe portion.

8. The shoe system of claim 1, wherein the first shoe portion is a type of an upper selected from a group consisting of a clog-style upper, a slide-style upper, a flip-flop style upper, and a loafer-style upper.

9. The shoe system of claim 1, wherein the first shoe portion is a different color, pattern, or texture from the second shoe portion.

10. The shoe system of claim 1, wherein the second shoe portion is configured to be slip-resistant or oil-resistant.

11. A shoe system comprising:

a first shoe portion comprising an upper portion and an insole portion, the upper portion and the insole portion consisting of a single injection piece, the first shoe portion including one or more plugs extending laterally from the first shoe portion; and a second shoe portion consisting of a single injection piece, the second shoe portion including one or more apertures formed in at least one side of the second shoe portion and sized to receive the one or more laterally extending plugs of the first shoe portion;

wherein the second shoe portion is configured to be removably attached to the first shoe portion when the one or more laterally extending plugs of the first shoe portion are received in the one or more apertures formed in the at least one side of the second shoe portion, the one or more laterally extending plugs configured to extend substantially all the way through the corresponding one or more apertures in the second shoe portion, and wherein only the second shoe portion contacts a walking surface when the one or more laterally extending plugs of the first shoe portion are received in the one or more apertures of the second shoe portion.

12. The shoe system of claim 11, wherein the one or more plugs extending laterally from the first shoe portion are substantially of a shape selected from a group consisting of a parallelogram, a rectangle, a triangle, a circle, a square, a rhomboid, an oval, a pentagon, a hexagon, a heptagon, an octagon, a star, and a heart, and wherein the one or more apertures formed in at least one side of the second shoe portion are of are substantially of a shape selected from a group consisting of a parallelogram, a rectangle, a triangle, a circle, a square, a rhomboid, an oval, a pentagon, a hexagon, a heptagon, an octagon, a star, and a heart, and which corresponds to the shape of the one or more plugs extending laterally from the first shoe portion.

13. The shoe system of claim 11, wherein the first shoe portion is a type of an upper selected from a group consisting of a clog-style upper, a slide-style upper, a flip-flop style upper, and a loafer-style upper.

14. The shoe system of claim 11, wherein the first shoe portion is a different color, pattern, or texture from the second shoe portion.

15. The shoe system of claim 11 wherein the second shoe portion is configured to be slip-resistant or oil-resistant.

16. A multi-function shoe system comprising:

at least two first shoe portions, each of the at least two first shoe portions including an upper portion and an insole portion formed as a single injection piece, and each of the at least two first shoe portions including one or more plugs extending from the first shoe portion; and a second shoe portion formed as a single injection piece, the second shoe portion including one or more apertures formed in the second shoe portion and sized to receive the one or more plugs of either of the at least two first shoe portions;

wherein the second shoe portion is configured to be removably attached to either of the at least two first shoe portions at a given time when the one or more plugs of one of the at least two first shoe portions are received in the one or more apertures of the second shoe portion, the one or more plugs configured to extend substantially all the way through the one or more apertures, and wherein only the second shoe portion contacts a walking surface when the one or more plugs of either of the at least two first shoe portions are received in the one or more apertures of the second shoe portion.

17. The multi-function shoe system of claim 16, wherein the one or more plugs extending from each of the at least two first shoe portions consist of one or more plugs extending laterally from each first shoe portion, the one or more plugs extending laterally from each first portion being substantially of a shape selected from a group consisting of a parallelogram, a rectangle, a triangle, a circle, a square, a rhomboid, an oval, a pentagon, a hexagon, a heptagon, an octagon, a star, and a heart, and wherein the one or more apertures formed in the second shoe portion consist of one or more apertures formed in at least one side of the second shoe portion, the one or more apertures formed in at least one side of the second shoe portion being substantially of a shape selected from a group consisting of a parallelogram, a rectangle, a triangle, a circle, a square, a rhomboid, an oval, a pentagon, a hexagon, a heptagon, an octagon, a star, and a heart, and which corresponds to the shape of the one or more plugs extending laterally from each first shoe portion.

18. The multi-function shoe system of claim 16 wherein the at least two first shoe portions each consist of a different type of an upper selected from a group consisting of a clog-style upper, a slide-style upper, a flip-flop style upper, and a loafer-style upper.

19. The multi-function shoe system of claim 17 wherein the at least two first shoe portions are each a different color, pattern, or texture from the second shoe portion.

20. The multi-function shoe system of claim 19 wherein the at least two first shoe portions are different colors, patterns, or textures from each other.

21. The multi-function shoe system of claim 17 wherein the second shoe portion is configured to be slip-resistant or oil-resistant.

* * * * *